United States Patent [19]

Arneson

[11] Patent Number: 4,566,144

[45] Date of Patent: Jan. 28, 1986

[54] APPARATUS FOR BUFFING ARTICLES

[76] Inventor: Howard M. Arneson, Koch Rd., Corte Madera, Calif. 94925

[21] Appl. No.: 502,433

[22] Filed: Jun. 9, 1983

[51] Int. Cl.[4] ..... A47L 23/00

[52] U.S. Cl. ..... 15/3; 15/90; 15/97 R; 15/210 R; 51/7; 51/164 R; 51/164.1; 68/235 R

[58] Field of Search ..... 15/1, 3, 3.1, 90, 94, 15/97 R, 97 A, 210 R, 104 R, 209 R, 257 R; 68/235 R, 213; 134/6; 51/7, 17, 163.1, 164 R, 164.1, 164.5

[56] References Cited

U.S. PATENT DOCUMENTS 1,747,324 2/1930 Savitt ..... 15/90

2,912,803 11/1959 Simjian ..... 51/7

*Primary Examiner*—Edward L. Roberts

*Attorney, Agent, or Firm*—Townsend and Townsend

[57] ABSTRACT

Apparatus for buffing articles, such as leather goods, silverware and the like. The apparatus includes a container for receiving an article to be buffed. The interior of the container has a buffing material therein and is of a size to permit relative movement of the article and the buffing material so that, when the container is moved about, such as in the drum of a clothes dryer, the article and the buffing material move continuously into frictional engagement with each other causing a buffing action to occur. Several embodiments of the container are disclosed. A clothes dryer can be used for moving the container. In the alternative, a coin operated drum can be provided.

8 Claims, 16 Drawing Figures

APPARATUS FOR BUFFING ARTICLES

This invention relates to improvements in the buffing of articles and, more particularly, to buffing apparatus which provides a buffing action to articles of different types in a minimum of time and without operator attention.

BACKGROUND OF THE INVENTION

It is well known that shoes are generally shined by brushing them by hand with a bristle brush or buffing them with a cloth of a suitable buffing material. This requires a considerable amount of energy and time for busy people who consider this an inconvenience, especially if they have other things to accomplish in a given day. Moreover, to hold a shoe in one hand while the shoe is being brushed by a brush in the other hand causes both hands to become soiled or dirty, requiring that the hands be washed immediately afterwards. Buffing a shoe with a buffing cloth requires the shoe to be worn or to be mounted on a fixed support. It is no wonder that shining of shoes is simply a job which is put off for much too long a time. Eventually, the appearance of the person wearing the shoes suffers and requires some sort of immediate action which the wearer does not wish to do. While it is possible to get shoe shines at a shoe shine stand, these are found only at locations in a commercial area, such as in a downtown area or at an airport. A professional shoe shine costs money and takes time because the shoes typically remain on the feet of the wearer while being shined. This also is time consuming and an inconvenience which is to be avoided generally.

Because of these drawbacks, a need has arisen for improvements in the buffing of articles, such as shoes and goods of various types.

SUMMARY OF THE INVENTION

This present invention satisfies the aforesaid need by providing an improved buffing apparatus which is simple in construction and easy to use. Moreover, the invention permits buffing of articles of different types to be done without attention by the user of the apparatus. Thus, during the buffing operation, the user can turn his attention to other things and need not be present while the buffing action is taking place.

To this end, the present invention provides a holder or container which has an opening for receiving the article or articles to be buffed, the container having a closure for closing the opening after the article is therewithin. Also, within the container is a buffing material which buffs and hereby shines the article as the container is moved about, such as when the container tumbles about or rotates within the rotary bin, such as the rotary drum of a clothes dryer.

In one form of the invention, the container has a flexible bag therewithin for receiving the article or articles to be buffed. The bag also has buffing elements therewithin, each element having an outer surface provided with a buffing material thereon, and the bag is of a sufficient size to allow relative movement between the buffing elements and the article to be buffed as the container itself moves about under the influence of a drive means, such as a rotary drum of a clothes dryer. The relative movements of the buffing material and the article cause the buffing material of the elements to shine the article to a desired degree in a minimum of time. During this time, the container is being moved about continuously and without the need for user attention. Thus, the user can turn his attention to other things and not need to be present during the buffing operation.

In the buffing of a pair of shoes, for instance, each shoe is prepared for buffing by applying a polish or wax to it. Then, the shoe is inserted into a bag with the buffing elements. The polish or wax may be omitted, if desired. Usually only a single shoe is placed in the bag although a pair of shoes can be placed in the same bag if the bag is large enough. In the alternative, two such bags can be used in the container for a pair of shoes, assuming the container is large enough to accommodate both bags.

Once the movement of the container starts, the user can walk away from the buffing location and do other things. Usually in 5 to 15 minutes, a shoe or pair of shoes will be properly buffed to provide a high gloss to the surfaces of the shoes.

Various other features of the apparatus include the use of weights in the container to effectively cause a higher degree of frictional engagement between the buffing material and the article to be buffed. This feature assures the proper amount of buffing action for a particular article. Moreover, the container itself can be moved about randomly within a rotary bin as the bin rotates about its central axis. In the alternative, the container can be held in fixed position in a rotary bin with the container spaced inwardly from or against the inner periphery of the bin, depending upon the way in which it is desired that the container be moved about in buffing the articles in the container.

Another feature of the present invention is to provide a rotary bin that is coin actuated so that the bin and the container can be placed in a commercial establishment for shining of shoes. This feature does not require any operator supervision, and customers can shine their shoes quickly and easily without doing anything more than taking off their shoes and placing them into the container and then into the rotary bin.

The primary object of the present invention is to provide an improved buffing apparatus for use in buffing articles of different types, including shoes, wherein the apparatus includes container for receiving an article to be buffed and provided with buffing material therewithin for frictional engagement with the article so that that, as the container is moved about, such as under the influence of a rotary bin, the article and the buffing material can be moved relative to each other for a certain time period in all directions so that the entire exposed surface of the article can be buffed to a high gloss without requiring any effort on the part of the user of the apparatus except to put the article into or take the article out of the container.

Other objects of this invention will become apparent as the following specification progresses, reference being had to the accompanying drawings for an illustration of the invention.

IN THE DRAWINGS

Figure 1:
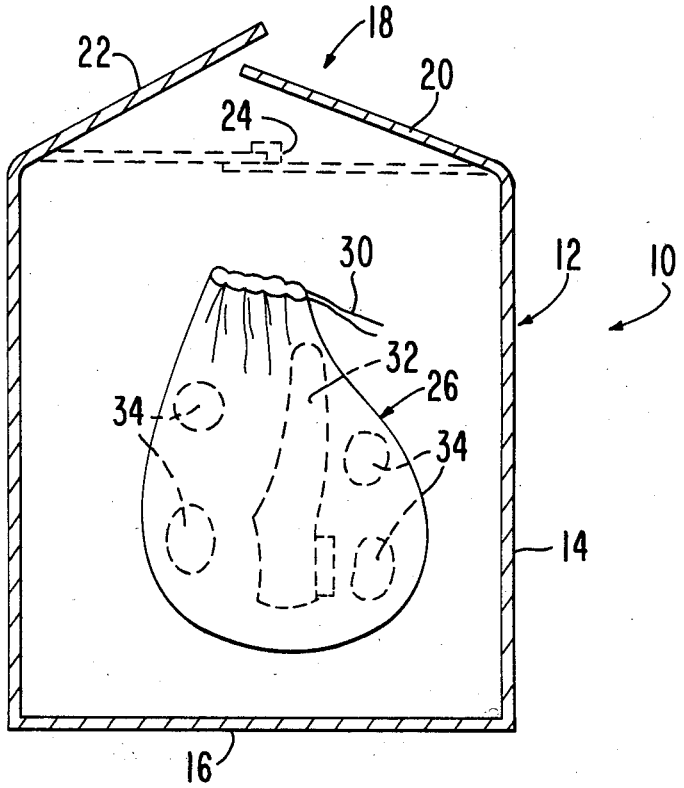
FIG. 1 is a vertical section through a container and a bag containing a shoe to be buffed and a number of inflatable buffing elements made in accordance with one embodiment of the present invention.
Figure 2:
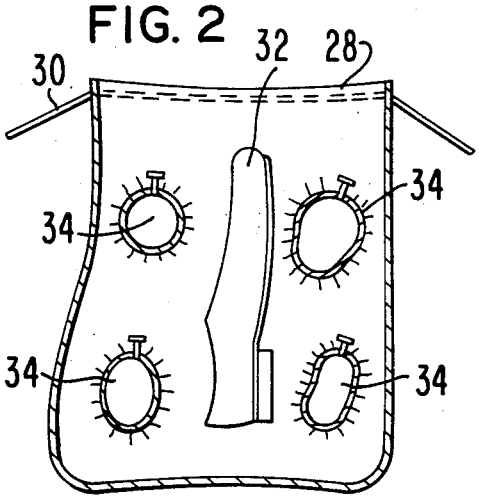
FIG. 2 is a cross-sectional view showing the bag used with the container of FIG. 1.
Figure 3:
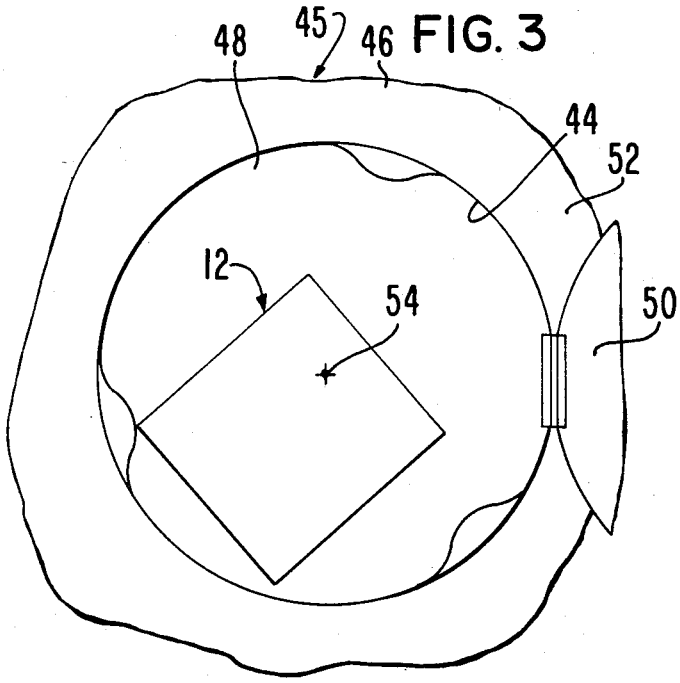
Figure 2A:
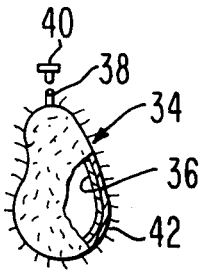
Figure 4:
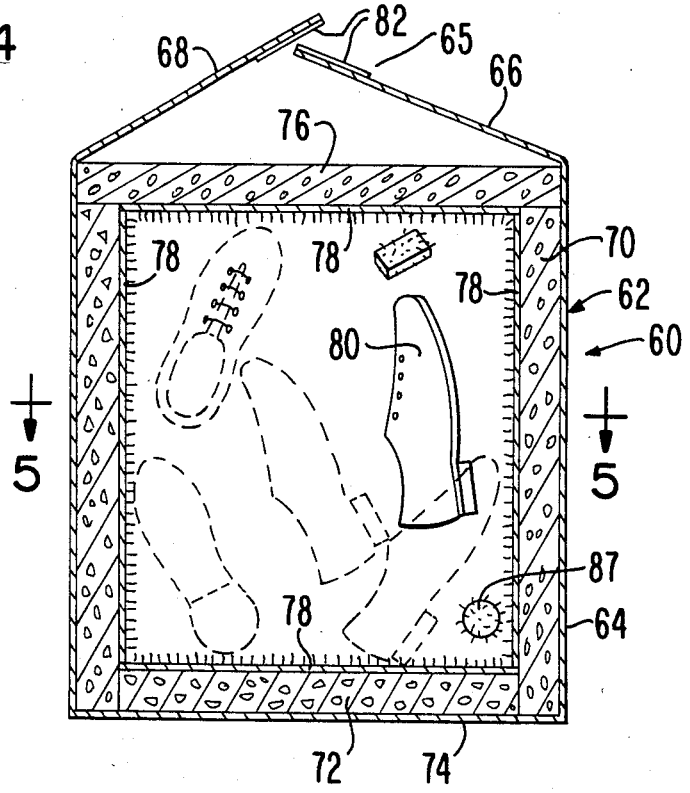
Figure 5:
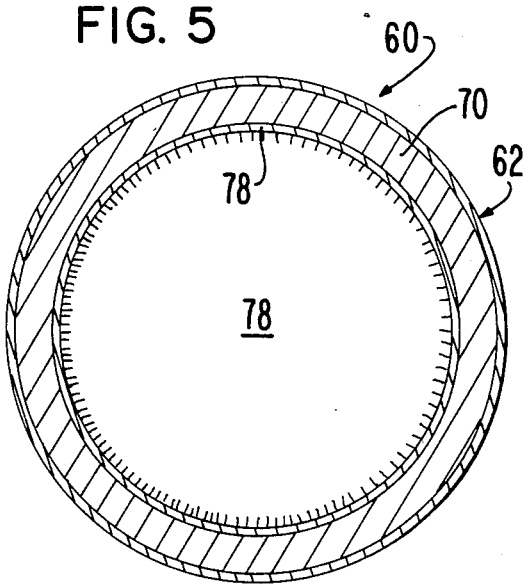
Figure 6:
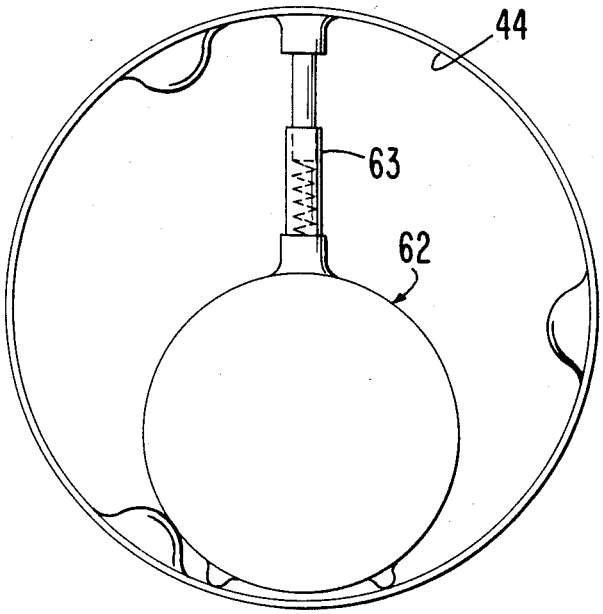
Figure 7:
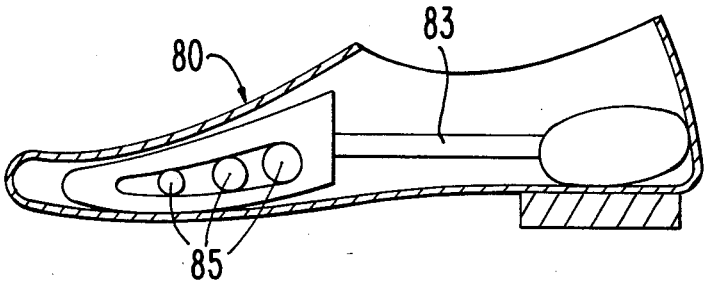
Figure 8:
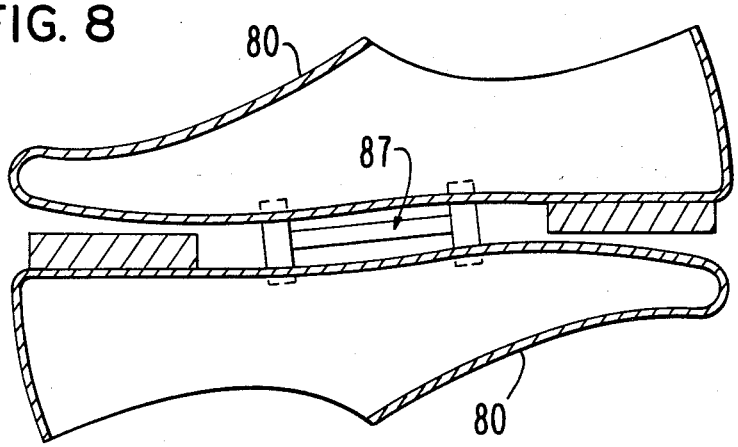
Figure 9:
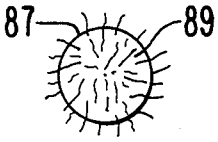
Figure 10:
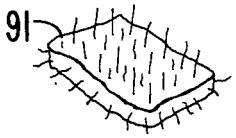
Figure 11:
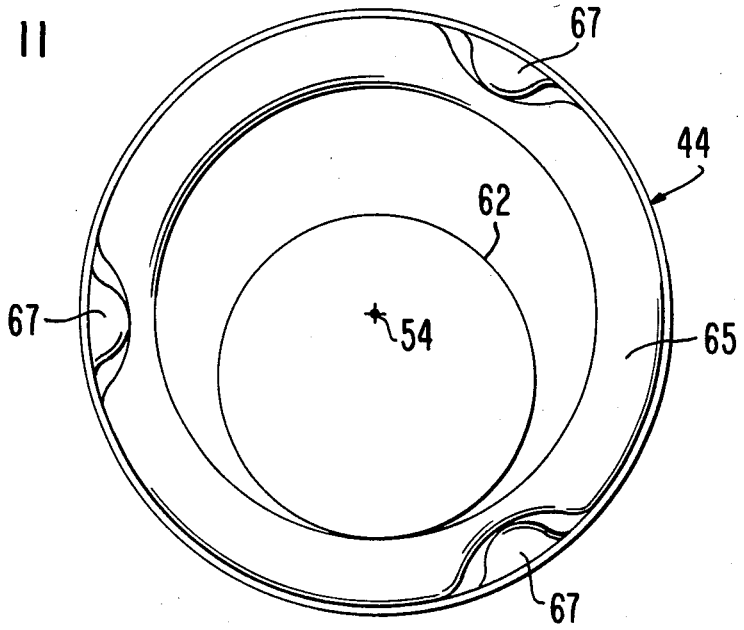
Figure 12:
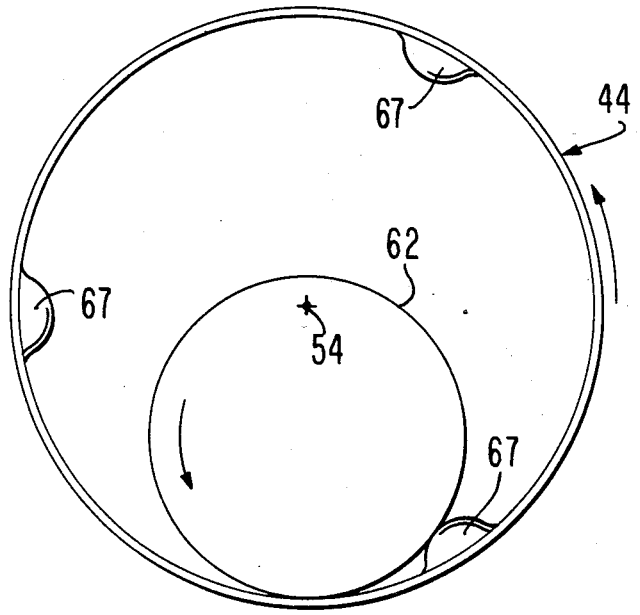
Figure 13:
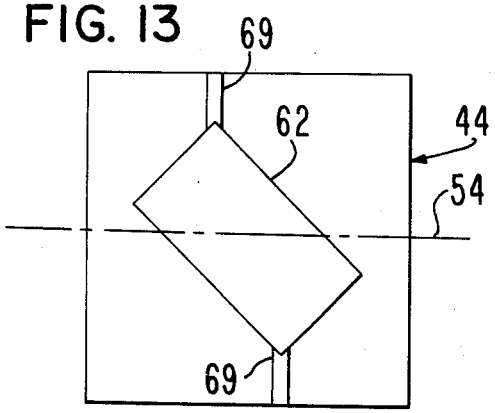
Figure 14:
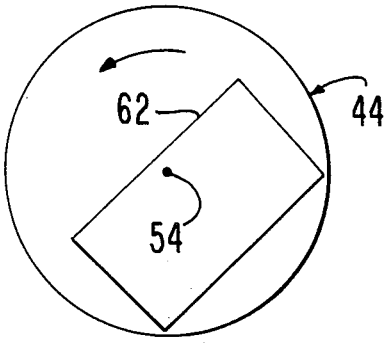
Figure 15:
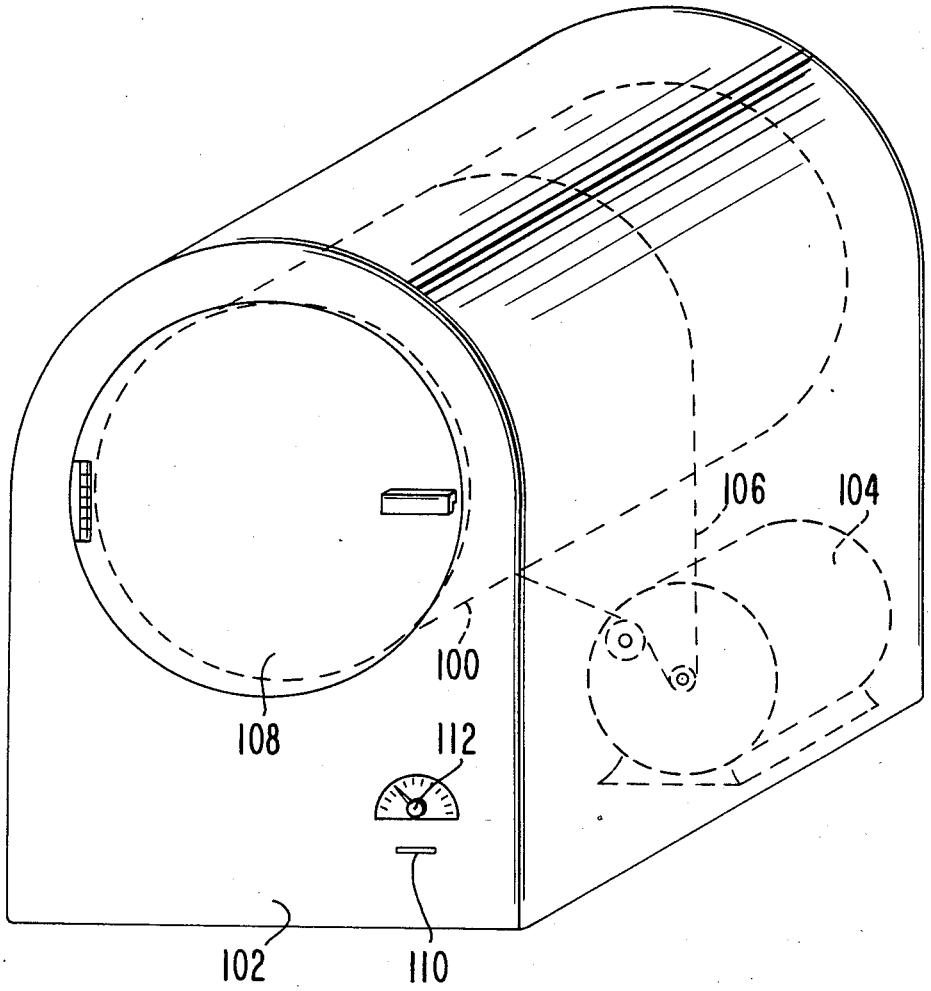

FIG. 2*a* is a side elevational view, partly in section, of one of the buffing elements for insertion in the bag of FIG. 2;

FIG. 3 is a fragmentary, front elevational view of a rotary bin, such as a conventional clothes dryer, for receiving the container of FIG. 1;

FIG. 4 is a view similar to FIG. 1 but showing a second embodiment of the container with a shoe therewithin;

FIG. 5 is a cross-sectional view taken along line 5—5 of FIG. 4;

FIG. 6 is a view similar to FIG. 3 but showing the way in which a container, such as the container of FIGS. 1 and 4, can be held in a rotary bin, such as the rotary drum of a conventional clothes dryer;

FIG. 7 is a vertical section through a shoe having a shoe tree provided with weights, the shoe being of the type for insertion into the containers of FIGS. 1 and 4;

FIG. 8 is a view similar to FIG. 7 but showing a pair of shoes coupled together for placement in the container of FIG. 4;

FIGS. 9 and 10 are perspective views of buffing elements which can be placed in the container of FIG. 4 to increase the buffing action on a shoe in the container as the container is shifted about in many directions;

FIG. 11 is a view similar to FIGS. 3 and 6 but showing the way in which the rotary drum of a clothes dryer can be provided with an inflatable element to cover the inner peripheral projections thereof;

FIG. 12 is a view similar to FIG. 11 showing the rotary drum without the inflatable member;

FIG. 13 is a schematic, side elevational view of a rotary bin having a container of the type shown in FIG. 4 held by a pair of end braces across the axis of rotation of the bin;

FIG. 14 is a view similar to FIGS. 1, 3, 11 and 12 but showing a container placed against the inner periphery of a rotary bin; and FIG. 15 is a perspective view of a coin operated rotary drive apparatus for use in commercial establishments for buffing shoes and other articles.

The embodiment of the buffing apparatus of the present invention will be described with respect to the buffing of shoes. However, it is understood that the apparatus is suitable for buffing other articles as well.

A first embodiment of the buffing apparatus of the present invention is broadly denoted by the numeral 10 and includes a container 12 having a side wall 14, a bottom wall 16, and a lid 18 comprised of a pair of hinged lid members 20 and 22 hingedly coupled to the upper margin of side wall 14. Container 12 can be of any shape; typically side wall 14 is cylindrical so as to present a circular bottom wall 16 and a circular lid 18. The lid can be kept closed by a fastener device 24 of any suitable construction, such as Velcro material.

The article to be buffed, placed in a flexible bag 26 having an open top 28 (FIG. 2) and a draw string 30 for removably closing the open top in the manner shown in FIG. 1. For purposes of illustration, bag 26 can be a fabric material. The bag is larger in size than the shoe.

In the bag are a number of buffing elements 34 which are generally of the same size and construction, although they could differ from each other, if desired. Each buffing element 34 is shown in more detail in FIG. 2*a*. It includes a flexible, hollow body 36 made of an inflatable material, such as rubber, which can expand to at least a small degree when inflated. Body 36 has a neck 38 through which a fluid, such as air or water, can be directed. A stopper 40 is removably coupled to neck 38 to close body 36 to retain the fluid therewithin.

A layer 42 of buffing material is on the outer surface of body 36. The outer surface of layer 42 is of a material suitable for buffing shoe 32 when container 12 is placed in a rotary bin and rotated in a manner to be described. The material suitable for layer 42 can be the usual cloth or fabric material used for shining shoes. It can have a pile or mat on a fabric base or it can have bristles as is well known in materials for shining shoes. The material used in conventional panty hose is also suitable for this purpose. The layer 42 is secured in any suitable manner, such as by an adhesive, to body 36. The fact that the body 36 can expand assures that the buffing element 34 will generally have a specific size and outer surface area so that it will properly buff the outer surface of the shoe to make the shoe surface shine to a high gloss as is normally desired as a result of a shoe shining operation.

In use, a shoe to be buffed is first placed in bag 26, following which elements 34, after being inflated, are also placed in the bag. A polish or wax may or may not be applied to the shoe. For purposes of illustration, four elements 34 are shown as being used in FIGS. 1 and 2. The size of the bag is such that it allows substantially free relative movement between elements 34 and the shoe 32 so that elements 34 can move about and buff different portions of the shoe simultaneously and in a random fashion. When, the drawstring 30 is pulled to close the open top 28 of bag 26, the bag is then ready to be placed in container 12 for tumbling or spinning in a rotary bin.

After bag 26 has been placed in the container, the lid of the container is closed and releasably held as shown in dashed lines in FIG. 1. Then the container is placed in a rotary bin, such as in the rotary drum 44 of a conventional clothes dryer 46 (FIG. 3) having a front opening 48 and a door 50 hingedly mounted on the front wall 52 of the dryer. FIG. 3 shows container 12 in rotor 44 before door 50 has been closed and before the start of rotation of the drum 44 about its rotational axis 54.

After the door 50 has been closed, the clothers dryer is actuated to cause rotation of the drum 44 about axis 54. Container 12 will freely tumble about within the drum and, as it does, the bag 26 will move randomly about within the container. As the bag moves within the container, elements 34 are caused to move relative to the shoe which also moves relative to and within the bag. As a result the shoe will be buffed by the buffing elements at all locations on the outer surface portions of the shoe. The shoe will be shined to a high gloss condition, such as after a certain period of time such as 5 to 10 minutes of rotation of drum 44.

After a predetermined time period of operation of the clothes dryer, the dryer is stopped and the container is removed from rotor 44, whereupon the container is opened and the bag 26 is removed. The shoe can be removed from the bag and replaced by another shoe for buffing.

While a single shoe has been shown as being contained in the bag 26, the bag can be large enough so that it will accommodate two shoes for simultaneous buffing by the elements 34. Moreover, the inner surface of the bag 26 can be provided with a buffing material so that, when the shoe contacts such inner surface of the bag, it will be buffed by the bag as well as by elements 34; thus, the bag and the elements will cooperate with each other during the buffing operation.

Elements 34 provide a certain amount of weight, especially if the elements contain a liquid, such as water, to assure that there will be sufficient frictional engagement between the elements and the shoe to be buffed. Thus, with the added weight provided by elements 34, the outer surface of the shoe can be properly buffed so as to provide an attractive shine for the shoe when the shoe is removed from bag 26.

While many different types of leather articles can be buffed by unit 10, metallic articles, such as articles of silverware can also be buffed by unit 10. Thus, the invention is not limited to shoes, although it is especially suitable for buffing shoes.

A typical length of container 12 is 24 to 27 inches, a typical diameter is 12 to 14 inches. This will give adequate space in the container to allow bag 26 to move about in the container as the container is rotated by rotor 44. Moreover in bag 26, shoe 32 moves constantly into different positions. Typically, it will remain in a position extending longitudinally of the bag. It will, however, tend to rotate longitudinally within the bag. As it does, the various outer surface portions of the shoe are contacted many times by the outer surfaces of elements 34, thus causing a frictional engagement between the shoe and the elements which causes the outer surface of the shoe to be buffed and thereby shined.

Another embodiment of the buffing unit of the present invention is broadly denoted by the numeral 60 and includes a container 62 having an outer side wall 64 of a suitable flexible material, such as a layer of canvas material. The container has a lid 65 comprised of a pair of hinged lid elements 66 and 68 which removably close the open top of the container.

A layer 70 of cushioning material, such as plastic foam, is adjacent to the inner surface of side wall 64. A circular bottom layer 72 of cushioning material covers the bottom wall 74 of container 62. Similarly, a circular member 76 of cushioning material is removably mounted in the open top of container 62.

Layers 78 of buffing material are secured to the inner surfaces of cushioning layers 70, 72 and 76. The buffing material can be a fabric provided with a pile or bristles for buffing an article in container 62. The material can be of the same material as used in panty hose. Any other suitable buffing material can be used for this purpose.

In use, a shoe 80 to be buffed is placed in the container 62 and layer 76 is placed over the open top, following which lid element 66 and 68 are closed. Velcro layers 82 can be used to keep the lip elements in their closed conditions. The shoe may or may not have a polish or wax applied thereto.

Then the container is loosely placed in a rotary bin, such as rotary drum 44 of clothes dryer 45 (FIG. 3). When the drum is rotated about its central axis 54, the container is caused to tumble about within the drum and, as it does, shoe 80 (FIG. 4) moves freely about in the container and frictionally engages the buffing material defined by layers 78. FIG. 4 shows in dashed lines the different positions which shoe 80 might assume as it freely and randomly moves about within and relative to container 62.

It may be desirable or deemed necessary to add weight to the shoe 80 to provide a greater frictional engagement of the shoe and buffing material and thereby a more effective buffing action. This will reduce the time during which container 62 is rotated by drum 44 to provide a desired shine on shoe 80. To this end, shoe 80 can, as shown in FIG. 7, be provided with a shoe tree 83 to add weight to the shoe itself. If additional weight is required, individual weights 85 (FIG. 7) can be added to the shoe tree 83 in any suitable manner. In the alternative, the shoe tree itself can be removed and the weights placed in the shoe and held therein in any suitable manner, such as by a masking tape or other fastener means.

FIG. 8 shows a pair of shoes 80 which are coupled together by a bracket 87 and held in sole-to-heel relationship. Then, both shoes, when coupled together, can be placed in container 62 and remain coupled together as the shoes move about and as the container 60 tumbles in drum 60. Generally, weight is generally not needed to be added to either shoe if they are coupled together in this manner because the combined weight of the shoes is sufficient to provide a good buffing action in a minimum of time.

It may be desirable to add one or more buffing elements to container 62 to increase the buffing action on shoe 80. These buffing elements are movable randomly in the container and can be of different sizes and shapes. FIG. 9 shows a ball-shaped buffing element 87 having an outer surface 89 provided with a buffing material, such as one having bristles. The interior of element 86 may be hollow and provided with lead shot or other weights to provide a more effective buffing action on the shoe. FIG. 10 shows a buffing element 91 which is in the form of a rectangular pad which is generally flexible so that it can conform to the surface of a shoe when it is adjacent to the shoe during tumbling of the shoe within container 62. Typically, there can be several ball-shaped elements 87 and several pad-shaped elements 91 in container 62 along with shoe 80.

FIG. 6 shows container 62 held by a spring-biased strut 63 in drum 44 so that the container is against the inner periphery of drum 44 at all times during rotation of the drum. This will assure that the article in the container to be buffed will move along a circular path about the central axis 54 of the drum and thereby caused to roll and tumble about in container 62 in a manner designed to cause the desired buffing action in a minimum of time.

FIG. 11 shows container 62 within drum 44 when the drum has an inflatable member 65 therewithin for covering the inner peripheral projections 67 normally found on the drum of a clothes dryer. The use of member 65 is for the purpose of reducing damage to the container in the rotor such as might occur when the container strikes the projections time after time during the rotation of the drum. Member 65 can be of any flexible material, such as rubber and can be inflated by air under pressure to a size to cause the member 65 to covers the projections as shown in FIG. 11. FIG. 12 shows container 62 in the drum 44 when there is no such member 65 in the drum and when the axis of the drum is substantially parallel to the axis of the container.

FIG. 13 shows container 62 in drum 44 when the container is fixed at an angle to the central axis 54 of the drum. The end margins of container 62 are held by braces 69 so that the longitudinal axis of the container 62 extends transversely of and at an acute angle with respect to axis 54.

FIG. 14 shows a view similar to FIG. 3 except that the length of the container with respect to the diameter of the rotor is relatively large, larger than the corresponding length and diameter of the container 12 shown in FIG. 3. This feature provides for an increased distance of travel for the shoe in the container in FIG. 14, thereby providing a greater buffing action, if such is desired.

FIG. 15 shows a rotary drum 100 in a housing 102 having a motor 104 coupled by a flexible belt 106 to the drum to rotate the drum about a generally horizontal axis. Housing 102 has a front door 108 which closes the front, open end of drum 100. A coin slot 110 is adjustable to a timing knob 112 and a coin-actuatd mechanism (not shown) is coupled to motor 104 to actuate the motor. The motor will not operate unless of coins of a particular amount are placed in coin slot 110 and timer 112 is set to a predetermined time interval.

When door 108 is opened, a shoe or pair of shoes can be placed in the drum for buffing. The shoes to be buffed are placed in a container in accordance with the teachings of FIG. 1 and FIG. 4, and the door is then closed, following which a coin is placed in slot 110 to energize motor 104. The motor will operate to rotate drum 100 for a certain period of time, during which time period the shoes will be buffed to a desired glass. When the time period has elapsed, the door may be opened and the shoes and container removed from the drum and the shoes will be ready to be worn immediately.

What is claimed is:

1. Buffing apparatus comprising: a container; a flexible bag for placement in the container and adapted for receiving an article capable of being buffed, said container adapted to be placed in a shiftable bin and moved about relative to a predetermined reference as the bin is shifted, there being a flexible, hollow element for placement in the bag and having a buffing surface engageable with the article in the bag, said element adapted to receive and contain a material, said container being of a size to permit the bag, the element and the article to move relative to the container as the container is moved relative to said reference.

2. Apparatus as set forth in claim 1, wherein the material received in the element is water.

3. Apparatus as set forth in claim 1, wherein the bag has an opening and means for closing the opening.

4. Apparatus as set forth in claim 1, wherein the bag is of a fabric material.

5. Buffing apparatus comprising: a container; a flexible bag for placement in the container and adapted for receiving an article to be buffed, said container adapted to be placed in a rotary bin and moved about relative to a predetermined reference as the bin is rotated, the bag and article being movable within and relative to the container as the container is moved relative to said reference; and a flexible, hollow buffing element in the bag and having an outer buffing surface frictionally engageable with the article in the bag.

6. Buffing apparatus comprising: a container; a flexible bag for placement in the container and adapted for receiving an article to be buffed, said container adapted to be placed in a rotary bin and moved about relative to a predetermined reference as the bin is rotated, the bag and article being movable within and relative to the container as the container is moved relative to said reference; and a buffing element in the bag, said element having a hollow, flexible body adapted to receive a fluid, there being a layer of buffing material on the outer surface of the body for defining an outer buffing surface frictionally engageable with the article in the bag.

7. Buffing apparatus comprising: a flexible bag adapted for receiving an article to be buffed, said bag adapted to be placed in a rotary bin and moved about relative to a predetermined reference as the bin is rotated, the article being movable within and relative to the bag as the bag is moved relative to said reference; and an inflatable buffing element in the bag and having an outer buffing surface frictionally engageable with the article in the bag.

8. Buffing apparatus comprising: a flexible bag adapted for receiving an article to be buffed, said bag adapted to be placed in a rotary bin and moved about relative to a predetermined reference as the bin is rotated, the article being movable within and relative to the bag as the bag is moved relative to said reference; and a buffing element in the bag, said element having a hollow, expandable body adapted to receive a fluid, there being a layer of buffing material on the outer surface of the body for defining an outer buffing surface frictionally engageable with the article in the bag.

* * * * *